US012454877B2

(12) United States Patent
Karakaya

(10) Patent No.: US 12,454,877 B2
(45) Date of Patent: Oct. 28, 2025

(54) MAINTAINING A TUBING HANGER PROFILE

(71) Applicant: Saudi Arabian Oil Company, Dhahran (SA)

(72) Inventor: Mustafa Karakaya, Izmir (TR)

(73) Assignee: Saudi Arabian Oil Company, Dhahran (SA)

( * ) Notice: Subject to any disclaimer, the term of this patent is extended or adjusted under 35 U.S.C. 154(b) by 86 days.

(21) Appl. No.: 18/479,451

(22) Filed: Oct. 2, 2023

(65) Prior Publication Data

US 2025/0109654 A1 Apr. 3, 2025

(51) Int. Cl.

| | |
|---|---|
| ***E21B 37/00*** | (2006.01) |
| ***E21B 34/02*** | (2006.01) |
| ***E21B 37/06*** | (2006.01) |

(52) U.S. Cl.

CPC ..... *E21B 37/00* (2013.01); *E21B 34/02* (2013.01); *E21B 37/06* (2013.01)

(58) Field of Classification Search

CPC ..... E21B 37/00; E21B 34/02; E21B 37/06; E21B 41/0078

See application file for complete search history.

(56) References Cited

U.S. PATENT DOCUMENTS

| | | | | |
|---|---|---|---|---|
| 6,607,607 | B2 * | 8/2003 | Walker | E21B 21/00 166/372 |
| 10,981,201 | B2 * | 4/2021 | Mackenzie | E21B 19/084 |
| 2012/0024521 | A1 | 2/2012 | Villa | |
| 2013/0000923 | A1 * | 1/2013 | Lee | E21B 21/103 166/321 |
| 2022/0081989 | A1 | 3/2022 | Muballa et al. | |
| 2022/0120155 | A1 | 4/2022 | Firth et al. | |

* cited by examiner

*Primary Examiner* — Catherine Loikith

(74) *Attorney, Agent, or Firm* — Fish & Richardson P.C.

(57) ABSTRACT

A valve lubrication tool includes a valve rod that includes a hollow tube with a bore that extends there through; and a valve profile lubricating assembly. The valve profile lubricating assembly includes a jetting nozzle coupled to the hollow tube. The jetting nozzle includes at least one fluid outlet configured to release a jet of a pressurized fluid that is circulated through the bore of the hollow tube to the jetting nozzle.

23 Claims, 3 Drawing Sheets

MAINTAINING A TUBING HANGER PROFILE

TECHNICAL FIELD

The present disclosure describes systems and methods for maintaining a tubing hanger profile into which a valve is set in a wellhead.

BACKGROUND

A back-pressure valve (BPV) is a type of a check valve (along with others, such as a two-way check valve (TWCV)), which is installed in a tubing hanger valve profile to isolate an upper wellhead section of production tubing/casing from pressure below. The BPV is designed to hold pressure from below by isolating well pressure, while allowing for a one-way flow path to pump fluid from above in case a well control issue occurs as part of killing a well with kill fluid. The BPV is typically used during isolation of the well as a barrier and during temporary isolation such as replacement of the "Christmas tree" or master valves.

During exploitation of a well over time, a profile of a tubing hanger for a wellhead valve (for example, a BPV or two-way check valve) can accumulate with some solids, debris, metal shavings, scale with mixture of viscous fluid or grease, especially during production, well intervention or wellhead greasing operations period. Accumulated solid, metal shavings, junk and debris across the BPV valve profile can cause potential malfunction of a BPV or a TWCV rod during the operations. For example, a BPV or TWCV may not set, may be difficult to set, or may be difficult to unset from a tubing hanger due to debris in the profile.

SUMMARY

In an example implementation, a valve lubrication tool includes a valve rod that includes a hollow tube with a bore that extends there through; and a valve profile lubricating assembly. The valve profile lubricating assembly includes a jetting nozzle coupled to the hollow tube. The jetting nozzle includes at least one fluid outlet configured to release a jet of a pressurized fluid that is circulated through the bore of the hollow tube to the jetting nozzle.

In an aspect combinable with the example implementation, the valve profile lubricating assembly includes a coupling that couples the jetting nozzle to the valve rod.

In another aspect combinable with any of the previous aspects, the at least one fluid outlet includes a plurality of fluid outlets.

In another aspect combinable with any of the previous aspects, the plurality of fluid outlets includes a first fluid outlet positioned at a distal end of the jetting nozzle and a set of fluid outlets positioned circumferentially about the jetting nozzle.

In another aspect combinable with any of the previous aspects, the first fluid outlet is configured to release a first jet in a first direction.

In another aspect combinable with any of the previous aspects, the set of fluid outlets are configured to release jets in a second direction opposite the first direction.

In another aspect combinable with any of the previous aspects, at least one of the plurality of fluid outlets includes a fluid outlet size between ⅛ and ¼ inches.

In another aspect combinable with any of the previous aspects, the valve rod is configured for rotation.

In another aspect combinable with any of the previous aspects, the valve rod is configured for reciprocation.

In another example implementation, a method for cleaning a valve profile of a wellhead includes running a valve lubricator tool into a wellhead. The valve lubricator tool includes a valve rod that includes a hollow tube with a bore that extends there through; and a valve profile lubricating assembly that includes a jetting nozzle coupled to the hollow tube and including at least one fluid outlet. The method includes circulating a flow of a pressurized fluid to the valve lubricator tool; circulating the flow of the pressurized fluid into the bore of the valve rod and to the jetting nozzle; releasing at least one jet of the pressurized fluid from the at least one fluid outlet; and cleaning a valve profile in the wellhead with the at least one jet of the pressurized fluid.

An aspect combinable with the example implementation further includes circulating the flow of the pressurized fluid through a coupling that couples the jetting nozzle to the valve rod.

In another aspect combinable with any of the previous aspects, the at least one fluid outlet includes a plurality of fluid outlets, and releasing the at least one jet of the pressurized fluid from the at least one fluid outlet includes releasing a plurality of jets of the pressurized fluid from the plurality of fluid outlets.

In another aspect combinable with any of the previous aspects, releasing the plurality of jets of the pressurized fluid from the plurality of fluid outlets includes releasing a first jet from a first fluid outlet positioned at a distal end of the jetting nozzle; and releasing a set of jets from a set of fluid outlets positioned circumferentially about the jetting nozzle.

In another aspect combinable with any of the previous aspects, releasing the first jet includes releasing the first jet from the first fluid outlet in a first direction.

In another aspect combinable with any of the previous aspects, releasing the set of jets includes releasing the set of jets from the set of fluid outlets in a second direction opposite the first direction.

In another aspect combinable with any of the previous aspects, at least one of the plurality of fluid outlets includes a fluid outlet size between ⅛ and ¼ inches.

Another aspect combinable with any of the previous aspects further includes rotating the valve rod in the wellhead during releasing the at least one jet of the pressurized fluid from the at least one fluid outlet.

Another aspect combinable with any of the previous aspects further includes reciprocating the valve rod in the wellhead during releasing the at least one jet of the pressurized fluid from the at least one fluid outlet.

In another aspect combinable with any of the previous aspects, the pressurized fluid includes a solvent, and cleaning the valve profile in the wellhead with the at least one jet of the pressurized fluid includes removing at least one of asphaltene, hydrate, wax, heavy mud, high solid content mud, high viscosity fluids, sand, or grease from the valve profile during circulation of the pressurized fluid through the valve rod.

Another aspect combinable with any of the previous aspects further includes operating one or more flow control valves of the valve lubrication tool; and based on the operation of the one or more flow control valves, circulating the pressurized fluid from the valve profile toward an outlet valve of the valve lubrication tool external to the valve rod in the wellhead.

Another aspect combinable with any of the previous aspects further includes circulating brine as the flow of the pressurized fluid into the bore of the valve rod and to the jetting nozzle; releasing at least one jet of the brine from the at least one fluid outlet; and killing the well with the released at least one jet of brine.

Implementations of systems and methods for lubricating a back pressure valve (BPV) according to the present disclosure can include one, some, or all of the following features. For example, example implementations according to the present disclosure can eliminate the need for slickline, coiled tubing, and workover/rig intervention operations to clean a tubing hanger valve profile. As another example, example implementations according to the present disclosure can help establish a clean and ready-to-set valve profile to accommodate isolation barriers at a wellhead. Further, example implementations according to the present disclosure can eliminate possible stuck valve operations inside of a tubing hanger by providing for a clean valve profile. Also, example implementations according to the present disclosure can remove grease, as well as debris and junk, with a solvent fluid circulated at a high pressure. As a further example, implementations according to the present disclosure can allow for special solvents to be circulated to remove hydrate (or viscous sludges, asphaltene or wax) in a production tree by circulating the solvent through a valve rod as a hollow tube and then in a volume between the BPV rod and the profile. Also, implementations according to the present disclosure can circulate a larger flow of a pressurized fluid or solvent through the valve rod as a hollow tube relative to conventional solid valve rods that do not allow fluid circulation through the BPV rod.

The details of one or more implementations of the subject matter described in this disclosure are set forth in the accompanying drawings and the description below. Other features, aspects, and advantages of the subject matter will become apparent from the description, the drawings, and the claims.

DETAILED DESCRIPTION

Figure 1:
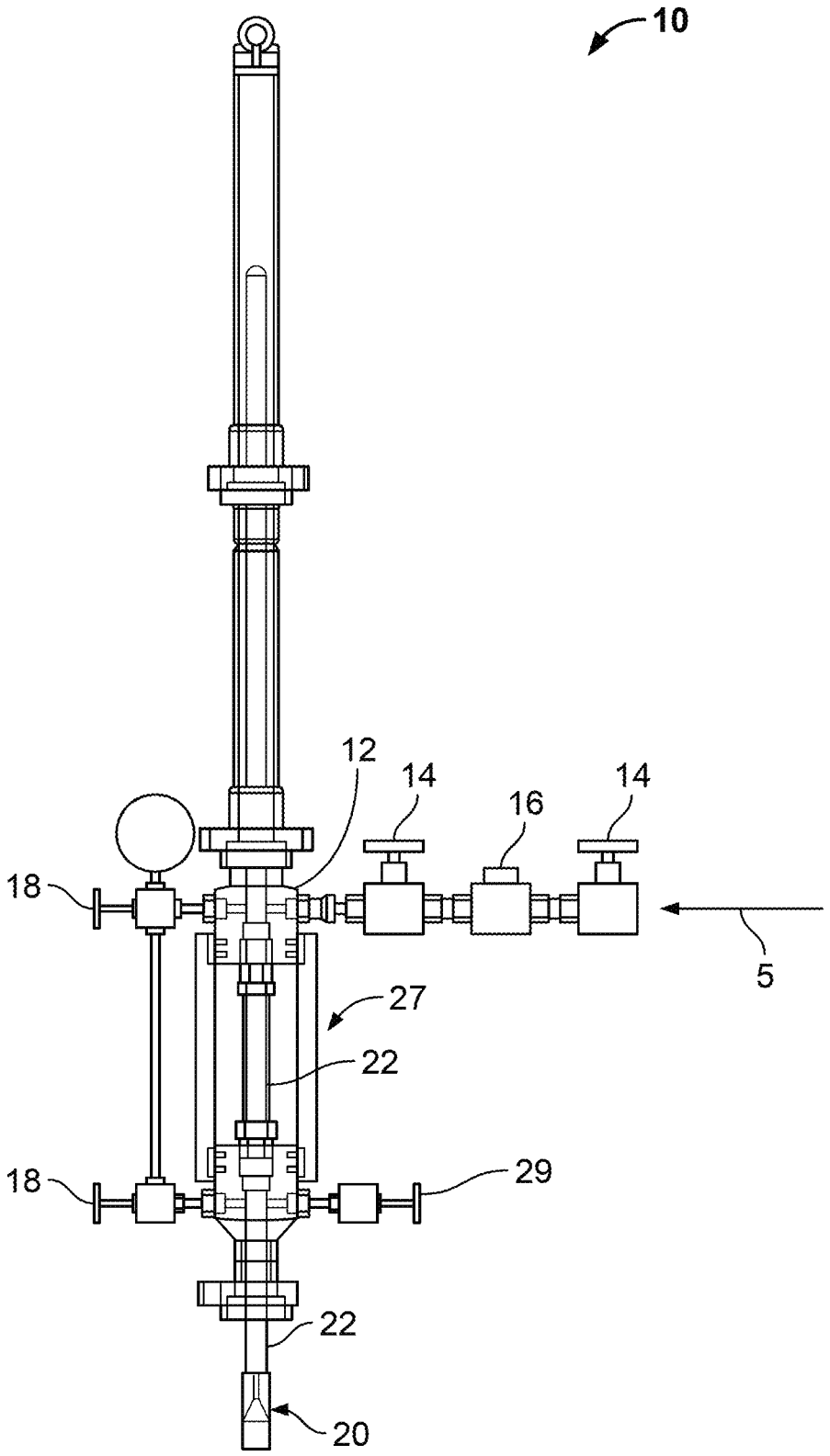
FIG. 1 is a schematic drawing of an example implementation of a back pressure valve (BPV) lubrication tool according to the present disclosure.

FIG. 1 is a schematic drawing of an example implementation of a valve lubrication tool 10 with a BPV profile lubricating assembly 20 according to the present disclosure. Generally, the valve lubrication tool 10 comprises a conventional or traditional lubrication tool in that valve lubrication tool 10 can be run into (or stung into) into a wellhead to install a wellhead valve, such as a back pressure valve (BPV) or two-way check valve (as two examples) into a tubing hanger or tubing hanger profile, also called a valve profile in some aspects. A "profile" according to the present disclosure, can comprise a surface (often circular or round in some aspects) into which a valve can be set, threaded, landed, or otherwise installed. Upon installation in the profile of the wellhead, a valve can be used to fluidly separate a portion of the wellhead downhole of the valve from another portion of the wellhead uphole of the back pressure valve. The valve can also allow for one way fluid flow, for example, in wellbore kill operations.

In some aspects, however, the profile in the tubing hanger into which the valve is installed can accumulate with some solids, debris, metal shavings, scale with mixture of viscous fluid or grease, especially during production, well intervention or wellhead greasing operations period. Accumulated solid, metal shavings, junk and debris across the valve profile can cause the valve, itself, to become stuck (and, for instance, irremovable). In this disclosure, examples of the valve lubrication tool 10 are described with reference to operations that involve a BPV and BPV valve profile as part of a tubing hanger. However, other types of wellhead valves are also contemplated as being applicable with the valve lubrication tool 10 of the present disclosure.

Indeed, during exploitation of a well over time, a BPV profile can accumulate with some solids, debris, metal shavings, scale with mixture of viscous fluid or grease, especially during production, well intervention, or wellhead greasing operations. First, solid debris accumulation occurs around the BPV profile area during well intervention, such as a coil tubing wellbore cleanout operation where a high volume of solids is passed through the wellhead area as part of the operation. Second, solid accumulation occurs during the pumping of high-rate fracturing operations with extensive amounts of solids, as well as during a production phase of the well where the BPV profile area can be exposed to formation sand/fines that came from downhole and accumulate inside of the BPV profile. Third, wellhead tree/valve greasing operations performed to keep valves within the wellhead tree functioning creates accumulated solids that can be pushed inside of the wellbore, thereby causing potential solid accumulation in the BPV profile area. When accumulated solids or debris are not cleaned properly, the BPV can be prevented from setting into the BPV profile, and, generally, challenges are created to retrieve the BPV from its set position. In some cases, the BPV can become stuck at the wellhead.

As shown in FIG. 1, the BPV profile lubricating assembly 20 is mounted on a BPV rod 22, which is a hollow rod or tube, of the valve lubrication tool 10. The valve lubrication tool 10 includes, among other conventional components, the BPV rod 22, a running and retrieving tool 12 that has pressure equalization ports and valves 18 to allow for a flow of pressurized fluid 5 through the tool 10 to through the BPV rod 22 (as explained in more detail herein). BPV rod 22, for instance, in this example, is a hollow rod that includes a bore through which the pressurized fluid can be circulated. Further components of the valve lubrication tool 10, in this example, include a check valve 16 and needle valves 14 that control a flow of the pressurized fluid 5 into the valve lubrication tool 10, through the BPV rod 22, and into the BPV profile lubricating assembly 20.

Figure 2:
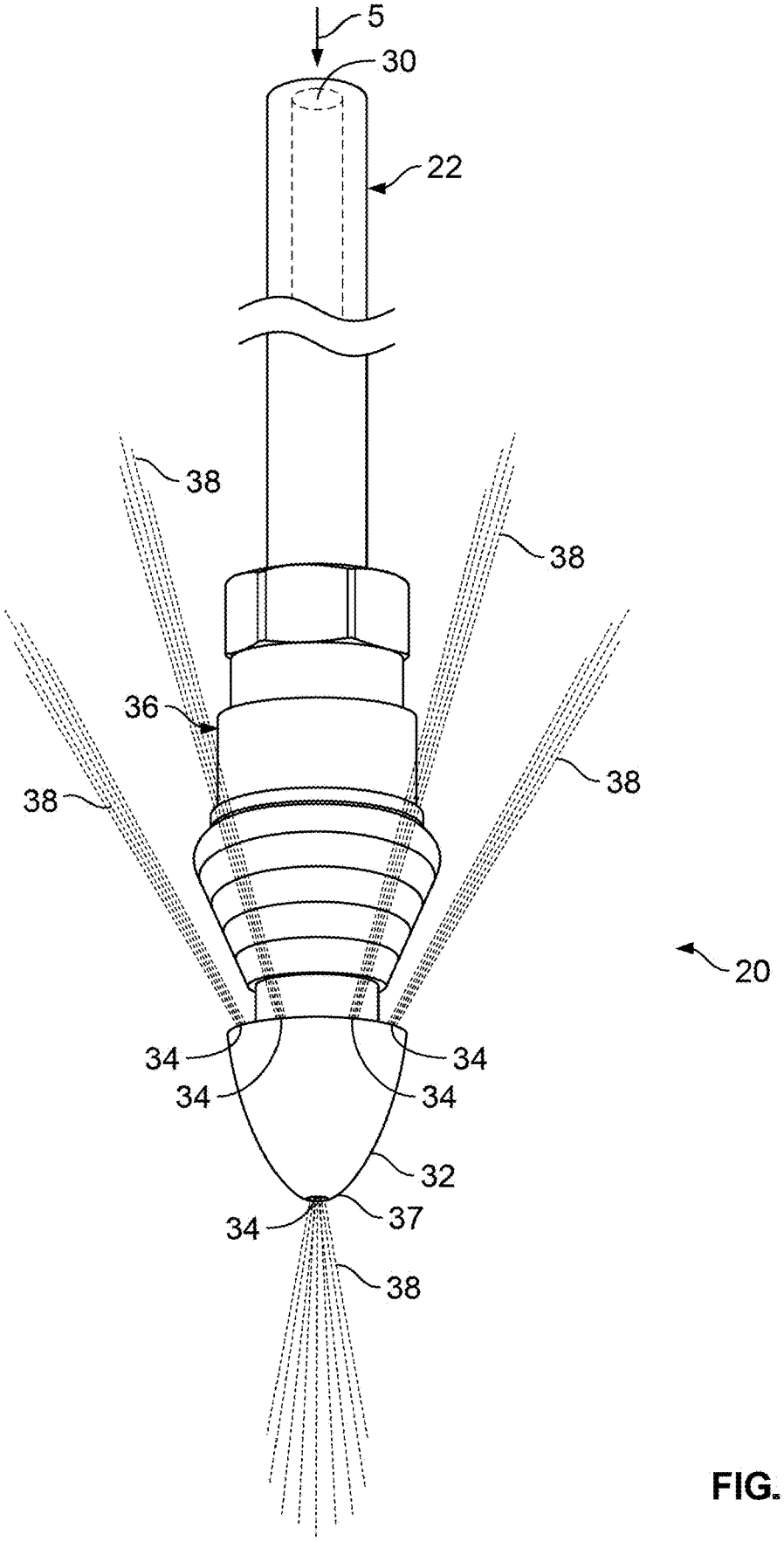
FIG. 2 is a schematic drawing of an example implementation of a jetting nozzle for a BPV lubrication tool according to the present disclosure.

Turning now to FIG. 2, this figure shows a schematic drawing of an example implementation of a jetting nozzle for the valve lubrication tool 10 according to the present disclosure. In this example implementation, the BPV profile lubricating assembly 20 is comprised of a coupling 36 that connects (for example, threadingly or otherwise) the BPV rod 22 to a jetting nozzle 32. The jetting nozzle 32 includes one or more outlets 34 that allow the pressurized fluid 5 to flow therethrough as fluid jets 38. In this example, there are multiple outlets 34; one of the outlets 34 is at a distal end 37 of the jetting nozzle 32 while other outlets 34 are arranged circumferentially around the jetting nozzle 32 near the coupling 36. As shown for example, the outlet 34 at the distal end 37 directs a jet 38 in a first direction (such as a downhole direction), while the other outlets 34 arranged circumferentially around the jetting nozzle 32 directs jets 38 in a second direction (such as an uphole direction) that is opposite the first direction. Other example implementations of the jetting nozzle 32 can include more or fewer outlets 34, or outlets 34 arranged in different locations or patterns, relative to the example shown in FIG. 2. The outlets 34 can, for example, have between a ⅛¼" opening to facilitate the output of the jets 38.

As further shown in FIG. 2, the BPV rod 22 includes a bore 30 that extends through the rod 22 such that the rod 22 is a hollow tube. The bore 30 fluidly couples the jetting nozzle 32 to the valve lubrication tool 10 so that the pressurized fluid 5 can be circulated through the tool 10 and to the jetting nozzle 32 through the bore 30 of the BPV rod 22.

Thus, with reference to FIGS. 1 and 2, the valve lubrication tool 10 with the BPV profile lubricating assembly 20 includes the jetting nozzle 32 coupled to the BPV rod 22 (as a hollow tube) to wash and help to effectively cleanout a BPV profile area with a flow of pressurized fluid 5. In some aspects, the valve lubrication tool 10 can be used prior to a BPV setting operation as a separate run (into the wellhead) with the valve lubrication tool 10.

The tool 10 can operate with relatively high-pressure conditions as well as with additional end use assemblies besides the jetting nozzle 32 so that the same valve lubrication tool 10 can be used to lubricate and clean the tubing hanger profile. For example, the valve lubrication tool 10 can be used to run into a wellhead to perform a lubrication operation and also run out of the wellhead under pressure. In some aspects, the BPV rod 22 is rotatable while run into the wellhead to better clean out debris from BPV profile area. Further, the BPV rod 22 can be reciprocated (either while rotating or not) up and down inside of the tubing hanger during a cleaning operation (in other words, while the jets 38 of the pressurized fluid 5 are output into the profile) to help clean the BPV profile area. Generally, an internal diameter (ID) of the BPV profile is bigger than the production tubing such that solid-rich fluid while flowing to a surface can settle into the BPV profile due to the ID increments.

The described example of the cleaning operation of the valve lubrication tool 10 can clean the tubing hanger profile without utilizing a high-rate pumping unit, coil tubing, or workover operations. For example, using the valve lubrication tool 10 in combination with a small, high-pressure pump to circulate pressurized fluid 5 rather than a high-rate pumping unit, coil tubing, or workover operations, a valve profile (such as a BPV profile) can be cleaned of, for example, solids, hydrate, wax, grease, or other undesirable materials to prevent potential BPV stuck challenges.

Figure 3:
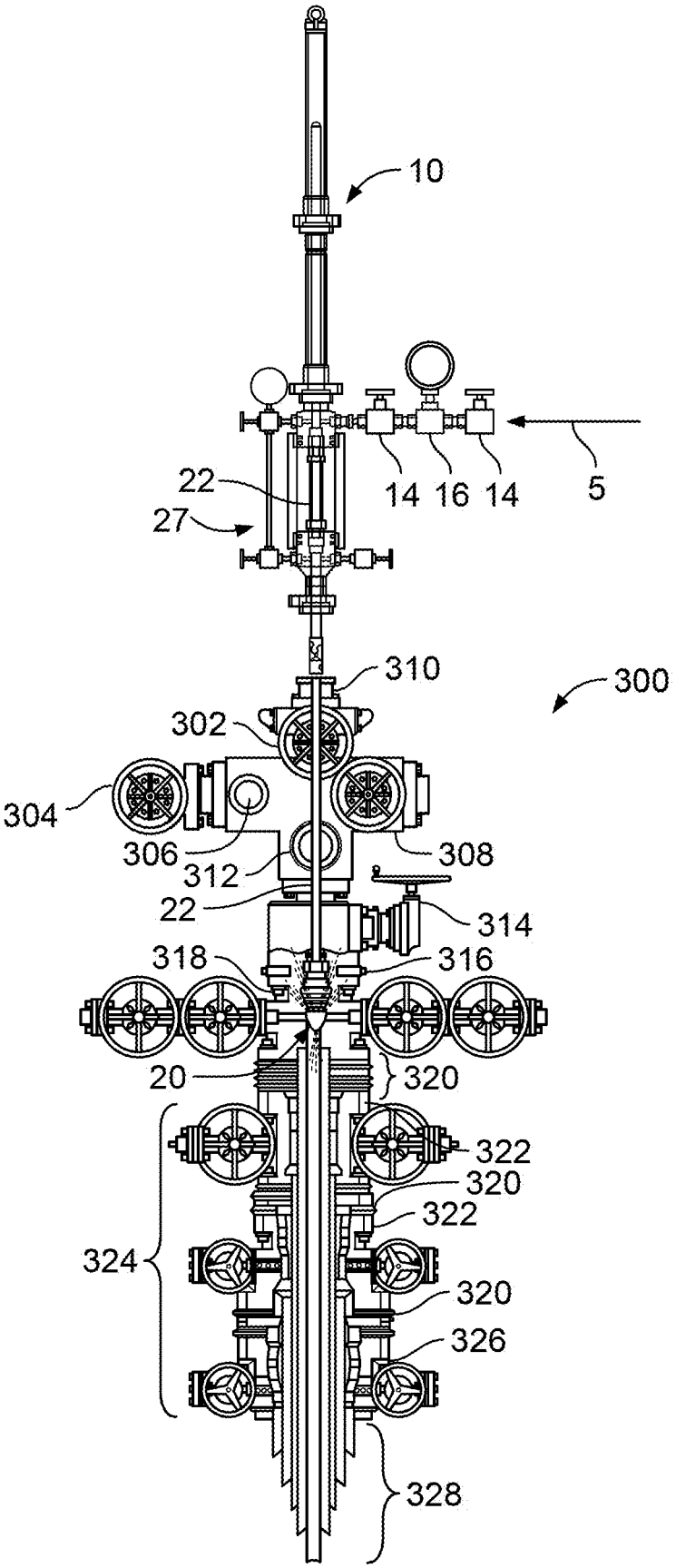
FIG. 3 is a schematic drawing of a portion of a wellhead that includes a tubing hanger and tubing hanger BPV profile into which a BPV lubrication tool according to the present disclosure can be positioned.

FIG. 3 is a schematic drawing of a portion of a wellhead 300 that includes a tubing hanger and tubing hanger valve profile (in this case, a BPV) into which the valve lubrication tool 10 according to the present disclosure can be positioned. For example, wellhead 300 (or the illustrated portion thereof) can be a conventional wellhead that includes, among other components, a manual crown valve 302, a hydraulic primary wing valve 306, a hydraulic secondary wing valve 304, a manual tubing kill valve 308, a crown adapter 310, a hydraulic middle master valve 312, a tubing manual lower master valve 314, a tubing head 316, a tubing hanger 318 (which includes or is a tubing hanger profile or valve profile), double studded adapters 320, casing spools 322, annulus valves 324, a casing head 326, and multiple casings 328.

As shown, the valve lubrication tool 10 is set into the wellhead 300 such that the BPV profile lubricating assembly 20 (including the jetting nozzle 32) is set into the profile of the tubing hanger 318. In an example operation, and with reference to FIGS. 1-3, the BPV profile lubricating assembly 20 can run into or otherwise be inserted into wellhead 300 on the valve lubrication tool 10. For example, the valve lubrication tool 10 can be installed (with the BPV profile lubricating assembly 20) on the wellhead 300 and pressure tested to ensure that the valve lubrication tool 10 connections are properly sealed. Next, production tree valves on the wellhead 300 can be opened and the BPV profile lubricating assembly 20 can be stung or set into the wellhead 300 (for example, just uphole of the tubing hanger 318). The jetting nozzle 32 of the BPV profile lubricating assembly 20 can be positioned in the profile. Next, the valves 14 and 16 can be operated to flow the pressurized fluid 5 through the valve lubrication tool 10 and into the BPV rod 22 (in other words, into the bore 30 of the rod 22). The pressurized fluid 5 flows through the BPV rod 22 and into the jetting nozzle 32, where the flow exits as jets 38. to clean the tubing hanger 318 of debris, junk, and grease.

During flow of the pressurized fluid 5 (and jets 38), the BPV rod 22 can be rotated or reciprocated, or both, within the tubing hanger 318. For example, a section 27 of the valve lubrication tool 10 can be opened under pressure (while the BPV rod 22 is inserted into the tubing hanger 318). Once the section 27 is open, the BPV rod 22 can be rotated and/or reciprocated (for example, by a manual operation with a wrench) within the tubing hanger 318.

Since a length of a BPV profile is between about 2-5", even a small amount of pressurized fluid 5 can clean the profile with the jetting nozzle 32 positioned in the BPV profile area. In some aspects, the bore 30 of the BPV rod 22 can have an inner diameter capable of circulating 1-2 gal/min flow rate therethrough. Since a working pressure of the valve lubrication tool 10 is about 25-50% higher than a wellhead pressure so the tool 10 can compensate to pump the pressurized fluid 5 at these rates.

In some aspects, the pressurized fluid 5 that is circulated into the BPV rod 22 to clean the valve profile is circulated back out of the wellhead through operation of the needle valves 14 and pressure equalization ports and valves 18. For example, in some cases, such as when a wellhead pressure is very high making it difficult to pump extra fluid, pressurized fluid 5 is circulated out from the valve lubrication tool 10 into the wellhead and back uphole and out of the wellhead through the pressure equalization ports and valve 18. This operation can be used if the wellhead is full of, for example, wax, asphaltene, and or hydrate and the BPV rod 22 cannot sting into the wellhead normally.

In some cases, production tree main gate valves also can be used for circulated out pressurized fluid. Especially if high viscosity fluids or high solid content fluids are circulated out, main production tree wing side gate valves can be used for circulation out of the wellhead.

In some aspects, circulation of the pressurized fluid 5 (in jets 38) out of the wellhead can occur by operation of the pressure equalization ports and valves 18. For example, the pressurized fluid 5 can flow into a top (or uphole end) of the BPV rod 22 (as a hollow tube) through the valving 14 and 16. Once circulated through the outlets 34 of the jetting nozzle 32 as jets 38, the pressurized fluid 5 can return in an annulus between the BPV rod 22 and the tubing hanger 318 and out of a valve 29 of the valve lubrication tool 10.

Once the described cleaning operation is completed (for example, after operation of the valve lubrication tool 10 for a particular time period), the valve lubrication tool 10 can be pulled from the wellhead 300 along with the BPV profile lubricating assembly 20. The wellhead production tree valves can be closed and the fluid pressure can be bled into the valve lubrication tool 10. The valve lubrication tool 10 can then be uninstalled from the wellhead 300. Once uninstalled, the BPV profile lubricating assembly 20 can be removed from the valve lubrication tool 10 and a back pressure or two-way check valve can be installed on the BPV rod 22. The valve lubrication tool 10 can then be reinstalled into the wellhead 300 so that the BPV or TWCV can be installed in the BPV profile.

Other example fluid bleed or injection operations can also be performed with the valve lubrication tool 10. For example, in situations in which a two-way check valve is installed in the wellhead (for example, in the tubing hanger 318) by the valve lubrication tool 10, a flow of brine (as the pressurized fluid 5) can be circulated through the bore 30 of the BPV rod 22. By circulating (or bleeding or injecting) a high density clean brine into the wellhead 300, the well can be killed while the two-way check valve is installed in the tubing hanger 318.

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

A number of implementations have been described. Nevertheless, it will be understood that various modifications may be made without departing from the spirit and scope of the disclosure. For example, example operations, methods, or processes described herein may include more steps or fewer steps than those described. Further, the steps in such example operations, methods, or processes may be performed in different successions than that described or illustrated in the figures. Accordingly, other implementations are within the scope of the following claims.

What is claimed is:

1. A back pressure valve (BPV) lubrication tool, comprising:

a valve rod that comprises a hollow tube with a bore that extends there through, the valve rod configured to run into a wellhead uphole of a tubing hanger of the wellhead; and a valve profile lubricating assembly, comprising:

a jetting nozzle coupled to the hollow tube, the jetting nozzle comprising at least one fluid outlet configured to release a jet of a pressurized fluid that is circulated through the bore of the hollow tube to the jetting nozzle and to the tubing hanger.

2. The BPV lubrication tool of claim 1, wherein the valve profile lubricating assembly comprises a coupling that couples the jetting nozzle to the valve rod.

3. The BPV lubrication tool of claim 1, wherein the at least one fluid outlet comprises a plurality of fluid outlets.

4. The BPV lubrication tool of claim 3, wherein the plurality of fluid outlets comprises a first fluid outlet positioned at a distal end of the jetting nozzle and a set of fluid outlets positioned circumferentially about the jetting nozzle.

5. The BPV lubrication tool of claim 4, wherein the first fluid outlet is configured to release a first jet in a first direction.

6. The BPV lubrication tool of claim 5, wherein the set of fluid outlets are configured to release jets in a second direction opposite the first direction.

7. The BPV lubrication tool of claim 3, wherein at least one of the plurality of fluid outlets comprises a fluid outlet size between ⅛ and ¼ inches.

8. The BPV lubrication tool of claim 1, wherein the valve rod is configured for rotation.

9. The BPV lubrication tool of claim 8, wherein the valve rod is configured for reciprocation.

10. A method for cleaning a back pressure valve (BPV) profile of a wellhead, comprising:

running a valve lubricator tool into a wellhead, the valve lubricator tool comprising:

a valve rod that comprises a hollow tube with a bore that extends there through, wherein running the valve lubricator tool into the wellhead comprises positioning the valve rod into the wellhead uphole of a tubing hanger of the wellhead; and a valve profile lubricating assembly, comprising:

a jetting nozzle coupled to the hollow tube, the jetting nozzle comprising at least one fluid outlet;

circulating a flow of a pressurized fluid to the valve lubricator tool;

circulating the flow of the pressurized fluid into the bore of the valve rod and to the jetting nozzle;

releasing at least one jet of the pressurized fluid from the at least one fluid outlet into the tubing hanger of the wellhead; and cleaning the BPV profile in the wellhead with the at least one jet of the pressurized fluid.

11. The method of claim 10, further comprising circulating the flow of the pressurized fluid through a coupling that couples the jetting nozzle to the valve rod.

12. The method of claim 10, wherein the at least one fluid outlet comprises a plurality of fluid outlets, and releasing the at least one jet of the pressurized fluid from the at least one fluid outlet comprises releasing a plurality of jets of the pressurized fluid from the plurality of fluid outlets.

13. The method of claim 12, wherein releasing the plurality of jets of the pressurized fluid from the plurality of fluid outlets comprises:

releasing a first jet from a first fluid outlet positioned at a distal end of the jetting nozzle; and releasing a set of jets from a set of fluid outlets positioned circumferentially about the jetting nozzle.

14. The method of claim 13, wherein releasing the first jet comprises releasing the first jet from the first fluid outlet in a first direction.

15. The method of claim 14, wherein releasing the set of jets comprises releasing the set of jets from the set of fluid outlets in a second direction opposite the first direction.

16. The method of claim 12, wherein at least one of the plurality of fluid outlets comprises a fluid outlet size between ⅛ and ¼ inches.

17. The method of claim 10, further comprising rotating the valve rod in the wellhead during releasing the at least one jet of the pressurized fluid from the at least one fluid outlet.

18. The method of claim 17, further comprising reciprocating the valve rod in the wellhead during releasing the at least one jet of the pressurized fluid from the at least one fluid outlet.

19. The method of claim 10, wherein the pressurized fluid comprises a solvent, and cleaning the BPV profile in the wellhead with the at least one jet of the pressurized fluid comprises removing at least one of asphaltene, hydrate, wax, heavy mud, high solid content mud, high viscosity fluids, sand, or grease from the BPV profile during circulation of the pressurized fluid through the valve rod.

20. The method of claim 10, further comprising:

operating one or more flow control valves of the valve lubrication tool; and based on the operation of the one or more flow control valves, circulating the pressurized fluid from the BPV profile toward an outlet valve of the valve lubrication tool external to the valve rod in the wellhead.

21. The method of claim 10, further comprising:

circulating brine as the flow of the pressurized fluid into the bore of the valve rod and to the jetting nozzle;

releasing at least one jet of the brine from the at least one fluid outlet; and killing the well with the released at least one jet of brine.

22. A method for cleaning a valve profile of a wellhead, comprising:

running a valve lubricator tool into a wellhead, the valve lubricator tool comprising:

a valve rod that comprises a hollow tube with a bore that extends there through; and a valve profile lubricating assembly, comprising:

a jetting nozzle coupled to the hollow tube, the jetting nozzle comprising at least one fluid outlet;

circulating a flow of a pressurized fluid to the valve lubricator tool;

circulating the flow of the pressurized fluid into the bore of the valve rod and to the jetting nozzle;

releasing at least one jet of the pressurized fluid from the at least one fluid outlet;

rotating the valve rod in the wellhead during releasing the at least one jet of the pressurized fluid from the at least one fluid outlet; and cleaning a valve profile in the wellhead with the at least one jet of the pressurized fluid.

23. A method for cleaning a valve profile of a wellhead, comprising:

running a valve lubricator tool into a wellhead, the valve lubricator tool comprising:

a valve rod that comprises a hollow tube with a bore that extends there through; and a valve profile lubricating assembly, comprising:

a jetting nozzle coupled to the hollow tube, the jetting nozzle comprising at least one fluid outlet;

circulating a flow of a pressurized fluid to the valve lubricator tool;

circulating the flow of the pressurized fluid into the bore of the valve rod and to the jetting nozzle;

releasing at least one jet of the pressurized fluid from the at least one fluid outlet;

cleaning a valve profile in the wellhead with the at least one jet of the pressurized fluid;

circulating brine as the flow of the pressurized fluid into the bore of the valve rod and to the jetting nozzle;

releasing at least one jet of the brine from the at least one fluid outlet; and killing the well with the released at least one jet of brine.

* * * * *